United States Patent [19]

von Alven et al.

[11] 4,394,919

[45] Jul. 26, 1983

[54] CLOSURE FOR CONTAINER

[75] Inventors: Raymond D. von Alven, San Rafael; Lee E. McGill, Orinda, both of Calif.

[73] Assignee: Cutter Laboratories, Inc., Berkeley, Calif.

[21] Appl. No.: 286,117

[22] Filed: Jul. 23, 1981

[51] Int. Cl.[3] ..... B65D 41/32

[52] U.S. Cl. ..... 215/253; 220/257; 220/270; 220/271; 215/249

[58] Field of Search ..... 215/249, 251, 253, 254, 215/256; 220/257, 270, 273

[56] References Cited

U.S. PATENT DOCUMENTS

| | | | |
|---|---|---|---|
| 3,025,988 | 3/1962 | Williams | 215/253 |
| 3,281,007 | 10/1966 | Dorosz | 220/270 |
| 3,397,812 | 8/1968 | Batchelar | 220/273 |
| 4,171,236 | 10/1979 | Winchell et al. | 215/253 X |
| 4,207,988 | 6/1980 | Prouty et al. | 215/249 X |

FOREIGN PATENT DOCUMENTS

| | | | |
|---|---|---|---|
| 1536175 | 1/1970 | Fed. Rep. of Germany | 220/270 |

*Primary Examiner*—Donald F. Norton

*Attorney, Agent, or Firm*—Robert E. Allen; David J. Aston

[57] ABSTRACT

A closure for containers which is inexpensively and easily manufactured and is readily removeable in whole or in part to gain access to contents in the container. The closure comprises a generally flat cap member sealed at its periphery to the mouth of the container. An upstanding tubular member on the surface of the cap is partially surrounded by a score line in the cap and the score line preferably continues all around the cap near its periphery. The tubular member preferably has rigidifying means in its closed top and side walls which can be readily flexed inwardly so that the tubular member can be firmly grasped and pulled to readily initiate a rupture in the score line at a stress-concentrating focal point on that portion of the score line adjacent the tubular member. The cap can then be easily removed by continued pulling of the tubular member.

16 Claims, 10 Drawing Figures

CLOSURE FOR CONTAINER

BACKGROUND OF THE INVENTION

This invention relates to closures for containers and more particularly to closures for containers used in storing parenteral solutions and the like.

The majority of containers currently in use for storing and dispensing parenteral or irrigation solutions or the like are semi-rigid or collapsible plastic containers. Parenteral solution containers typically have a spike entry port and a medicinal entry or additive port with piercable diaphragms. To preserve the surface sterility of these ports, they are protected by outer closures which are generally hermetically sealed over or around these ports and are removable prior to the ports being entered by a spike of an administration set or a needle or spike of an additive solution container. Typical of such closures are those shown in U.S. Pat. Nos. 3,394,831, 3,978,859, 4,111,324, 4,187,893, 4,199,071, 4,207,988 and 4,228,835. U.S. Pat. Nos. 3,281,007, 3,407,957 and 3,981,412 are representative of those which show removable plastic closures on containers used in the soft drink industry.

The closures referred to in these patents all suffer certain deficiencies. A portion of the closure in each case is removed by rupturing of a thinned section or scoreline. However, the initiation of rupture is often difficult, particularly with the types such as those shown in patents 3,981,412 and 3,978,859. In addition, most of the closures in the above-cited patents are generally more expensive and difficult to mold in commonly used injection molding operations than a more simplified design as shown in patent 3,981,412 for example.

SUMMARY OF THE INVENTION

The closure of the present invention comprises a generally flat cap which is sealed at its periphery to the mouth of a container so as to protect the interior of the container from contamination. The cap has a score line which may be either in the inner or outer surface of the cap and provides a thinned section capable of rupture to cause at least a portion of the cap to be removed. A rupture or tear-initiating means is associated with the score line at a focal point or stress-concentrating locus on the score line. The tear-initiating means comprises a tubular member extending upwardly from the cap. By gripping the tubular member and pulling or bending this member, rupture of the score line at the focal point is readily accomplished and the cap or a portion thereof may be easily removed.

The tubular member can be positioned anywhere on the cap but preferably is located near the periphery. The tubular member can have a variety of shapes, e.g., circular, rectangular, oval, etc., and preferably is oval. The top wall of the tubular member preferably has rigidifying means, as for example, its thickness is greater than portions of the side wall. Alternatively, the top wall need not be thicker but may be provided with one or more projections or ribs. Preferably the side walls are not of uniform thickness so that the walls may be more readily compressed and, together with the more rigid top wall, allows the member to be more firmly grasped. The bottom of the tubular member may be open and it is this configuration which allows the simpliest design of the closure of this invention to be formed as in an injection molded procedure.

The score line at the stress-concentrating locus should be an angularly converging configuration, preferably one which comes to a point to form an apex. It is preferred that the tubular member bears a rib or a force-directing means at its base which ends directly at the apex so that higher stress is placed on the score line at the apex when the tubular member is manipulated and rupture occurs easily at the apex.

DETAILED DESCRIPTION OF THE INVENTION

Figure 1:
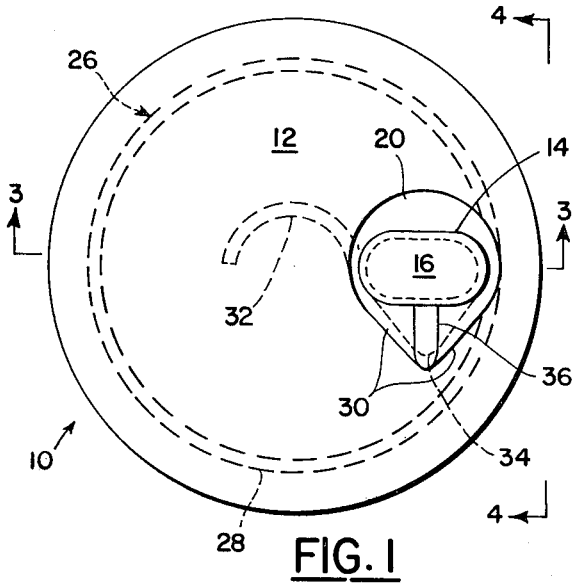
FIG. 1 is a plan view of a closure in accordance with the present invention.
Figure 2:
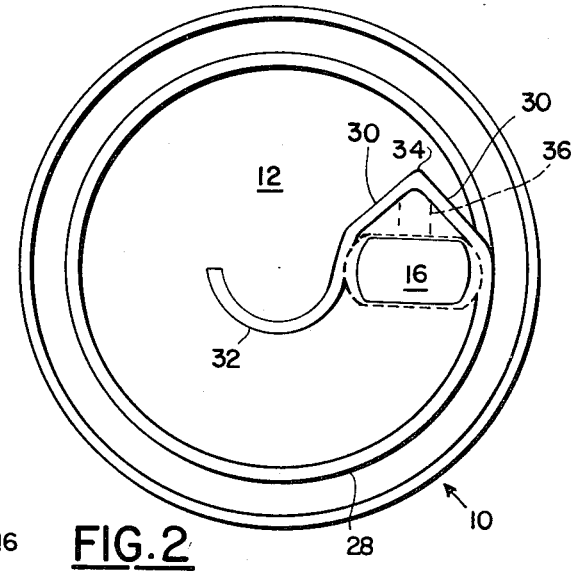
FIG. 2 is a view taken from the underside of the closure of FIG. 1.
Figure 3:
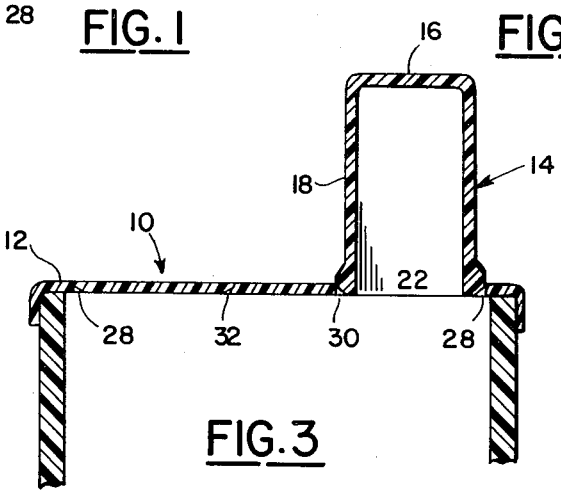
FIG. 3 is a view in cross-section of the closure of FIG. 1 taken along the line 3—3, showing the closure sealed to the mouth on the neck of a container.
Figure 4:
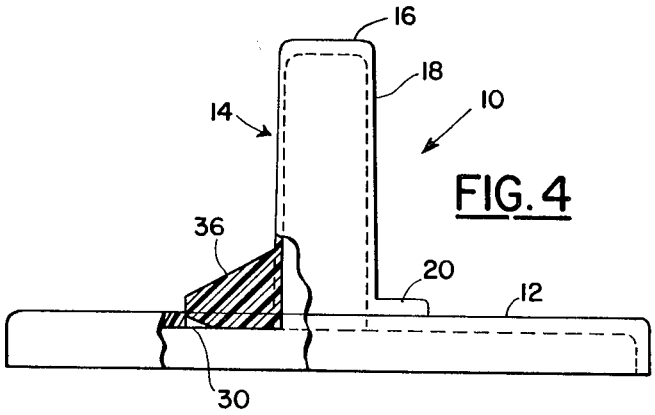
FIG. 4 is an enlarged view partly in cross-section of the closure of FIG. 1 taken along the line 4—4.
Figure 5:
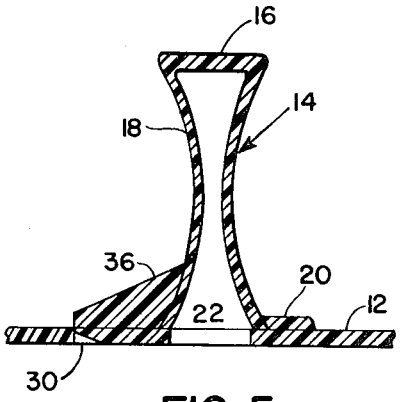
FIG. 5 is a partial view in cross-section of the view of the closure of FIG. 4 with the side walls of the tubular member under compression.

In FIGS. 1-3 a closure 10 is shown as comprising a flat cap 12 with a tubular member 14 extending upwardly therefrom. The tubular member 14 has a closed top 16, a side wall 18 and, in this instance, a base 20, the base providing additional support. The base, however, is not critical. There is an opening 22 connecting the interior of the tubular member 14 and the underside of cap 12.

Figure 9:
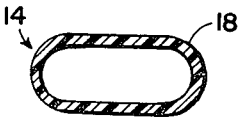
FIG. 9 is cross-sectional view of a modification of the tubular member portion of the closure of this invention, showing variations in the wall thickness.
Figure 10:
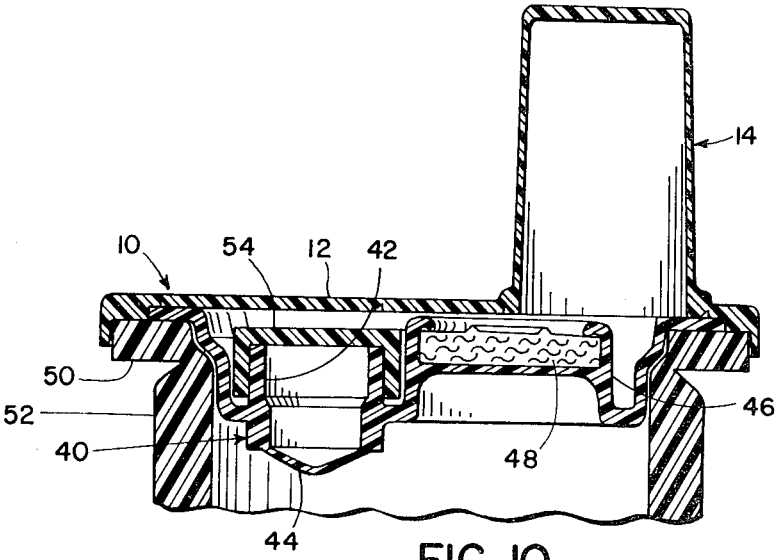
FIG. 10 is a view in cross section of the closure of this invention covering an inner closure, both closures being sealed to the mouth of the neck of a container.

Preferably, the side wall 18 of tubular member 14 has variations in its thickness. As shown in FIGS. 1-5, the wall thickness along the major cross sectional axis of the oval tubular member is less than the thickness along the prior axis. Alternatively, the side wall along the major axis can be thicker than the side wall along the minor axis, such as shown in FIG. 9, in which case the thinner portions act as hinges to allow for ready collapse of the side wall. The top wall 16 has a thickness equal to or greater than the thicker portions of the side wall which help to provide rigidity to the top wall so that when the side wall is grasped along the major axis by ones finger and thumb, the thinner walls collapse and the more rigid top wall provides resistance to the fingers.

Figure 6:
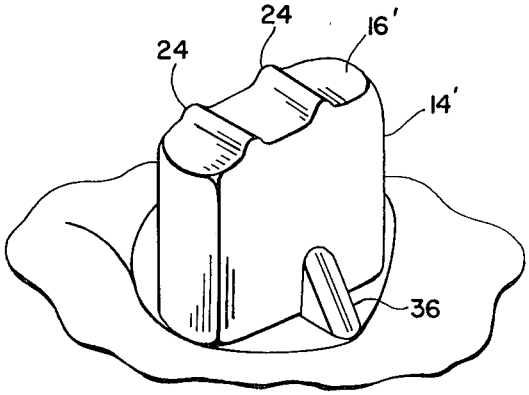
FIG. 6 is a view in perspective of another modification of the closure of this invention.
Figure 7:
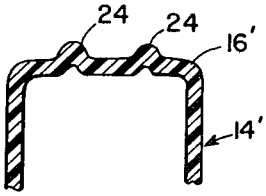
FIG. 7 is a cross-sectional view of part of the tubular member shown in FIG. 6.

The top wall may have other means for providing rigidity, as for example, by having one or more ribs 24 such as those shown in FIGS. 6 and 7. Here the ribs 24 are projecting upwardly from top wall $16^1$ of tubular member $14^1$ and are running parallel to the shorter axis. In this situation, the ribs provide sufficient rigidity so that the top wall need not be thicker than the side wall.

Alternatively, the ribs 24 may project from the inner surface of the top wall 16[1].

The location of tubular member 14 is not critical. It can be positioned on or near the center of cap 12 but a more preferred location is that shown in FIGS. 1–3, i.e., near the periphery of cap 12.

A score line 26 comprises a groove in the surface of the underside of cap 12. A score line portion 28 extends all the way around near the periphery of cap 12 and another portion 30 extends around approximately one half of the base 20 of tubular member 14. Preferably, portion 30 continues a short distance beyond tubular member 14, such as a curved portion 32. Portion 30 of score line 26 angularly converges at a point or apex 34 which provides a stress-concentrating locus on the cap 12. When the tubular member 14 is grasped and pulled or pushed in a direction towards or away from this locus, rupture of the score line 26 is readily initiated at apex 34. By continuing pulling of the tubular member 14, rupture of the score line proceeds simultaneously along portions 30 to the end of portion 32 and around portion 28 until the entire cap portion within score line portion 28 is removed.

A rib 36 may be included on tubular member 14 which is located between the side wall 18 and the base 20 and terminating at or near the apex 34 of score line 26. Rib 36 aids in concentrating stresses on the score line at this point when tubular member 14 is pulled.

Figure 8:
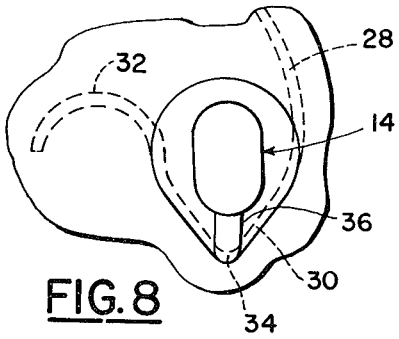
FIG. 8 is a plan view of part of another modification of the closure of this invention.

FIG. 8 illustrates another variation of the closure 10 wherein the tubular member 14 is positioned so that its longer axis is in a direct line leading toward the apex 34.

FIF. 10 is illustrative of the combination of the cap 12 as an outer closure and an inner closure 40 both of which are sealed at their peripheral portions to a mouth 50 on a neck 52 of a container (not shown). The inner closure 40 typically may have a spike entry port 42 with a piercable diaphragm 44 and a medicinal entry or additive port 46 with a resealable pad 48. Port 42 may have a removable cap 54 which frictionally engages the mouth of port 42.

The closure of the present invention is readily produced by an injection molding process requiring simple, uncomplicated molds. Any thermoplastic material can be used. Preferably the containers and the closures which are sealed onto the neck of the containers are both made of suitable polyolefins, for example, polyethylene, polypropylene or copolymers of these olefins.

The above description of several modifications of the closure of this invention are intended to be illustrative only and other modifications will occur to those skilled in the art to which this pertains. The invention is limited only to the extent to which the claims define the invention.

We claim:

1. A closure for a container for sealing the neck of the container comprising a generally flat cap hermetically sealed to the neck, a score line in a surface thereof, a tear-initiating means associated with the score line which comprises a hollow tubular member extending upwardly from the top surface of the cap and adapted for initiating a rupture of the score line at a stress-concentrating locus on the score line, said tubular member having a generally flat closed outer end and an open inner end which coincides with an opening in the surface of the cap, and said tubular member having a generally oval cross-section, said oval cross-section defining a major axis and a minor axis.

2. The closure of claim 1 wherein the closed end of the tubular member further includes rigidifying means.

3. The closure of claim 2 wherein the rigidifying means comprises the closed end of the tubular member having a thickness which is greater than the thickness of at least portions of side walls of the tubular member.

4. The closure of claim 3 wherein the side walls adjacent the major axis are thinner than the side walls adjacent the minor axis.

5. The closure of claim 3 wherein the side walls adjacent the minor axis are thinner than the side walls adjacent the major axis.

6. The closure of claim 3 wherein the sidewalls between the major and minor axes are thinner than the sidewalls adjacent the major and minor axes.

7. The closure of claim 3 wherein the sidewalls between the major and minor axes are thicker than the sidewalls adjacent the major and minor axes.

8. The closure of claim 2 wherein the rigidifying means comprises at least one rib on a surface of the closed end of the tubular member lying substantially parallel to the minor axis.

9. The closure of claim 1 wherein the score line comprises a first groove in a surface of the cap which extends all the way around the cap adjacent the sealed portion of the cap, a second groove in a surface of the cap, one end of the second groove commencing at the first groove, extending around a portion of the tubular member and terminating at a point intermediate the tubular member and the first groove.

10. The closure of claim 9 wherein the portion of the second groove extending around the portion of the tubular member generally forms an apex which comprises the stress-concentrating locus of the score line.

11. The closure of claim 10 wherein a rib joins a side wall of the tubular member to the top surface of the cap, the rib being positioned at the apex of the second groove.

12. The closure of claims 9, 10 or 11 wherein the tubular member is located adjacent the first groove.

13. A container with a closure for enclosing the neck on the container, the closure comprising a generally flat cap which extends across the neck and having an outer portion which is sealed to the rim on the neck, a first score line in the cap generally parallel to and extending adjacent to the entire sealed outer portion; a tubular gripping means having a closed outer end and an open inner end and extending vertically from the top surface of the cap, a second score line in the cap which is adjacent the tubular gripping means, the second score line having one end delineating part of a stress-concentrating area on the cap and the other end of the second score line terminating at the first score line, a third score line in the cap having one end joining said one end of the second score line and delineating the remaining part of the stress-concentrating area, the third score line extending beyond the tubular gripping means and having its other end terminate at a point intermediate the tubular gripping means and the first score line, the closed end of the tubular gripping means having rigidifying means on the closed outer end, said tubular gripping means being generally oval in cross section with a major axis and a minor axis.

14. The container of claim 13 wherein the tubular gripping means is located adjacent the first score line.

15. The container of claim 13 wherein the rigidifying means comprises the closed outer end having a thickness which is greater than the thickness of at least portions of side walls of the tubular gripping means.

16. The container of claim 13 wherein a rib joins a side wall of the tubular gripping means to the top surface of the cap within the stress-concentrating area between the second and third score lines.

* * * * *